United States Patent [19]

Dard et al.

[11] Patent Number: 4,896,006

[45] Date of Patent: Jan. 23, 1990

[54] ROTARY SWITCH ACTUATING MECHANISM FOR ACTUATING AT LEAST TWO PLUNGER CONTROL ELEMENTS

[75] Inventors: Pierre Dard, Le Pecq; Fabrice Maës, Ermont, both of France

[73] Assignee: La Telemecanique Electrique, France

[21] Appl. No.: 298,803

[22] Filed: Jan. 17, 1989

Related U.S. Application Data

[63] Continuation of Ser. No. 144,976, Jan. 19, 1988, abandoned.

[30] Foreign Application Priority Data

Sep. 30, 1987 [DE] Fed. Rep. of Germany ..... 8713156

[51] Int. Cl.[4] ..... H01H 3/20

[52] U.S. Cl. ..... 200/17 R; 200/330; 200/336

[58] Field of Search ..... 200/11 R, 17 R, 18, 200/330, 335–338, 293–296, 529, 553, 564, 573

[56] References Cited

U.S. PATENT DOCUMENTS

| | | | |
|---|---|---|---|
| 3,236,989 | 2/1966 | Zavertnik et al. | 200/294 |
| 4,181,838 | 1/1980 | Neuser et al. | 200/573 |
| 4,328,404 | 5/1982 | Palloch et al. | 200/335 X |

*Primary Examiner*—J. R. Scott

*Attorney, Agent, or Firm*—William A. Drucker

[57] ABSTRACT

A rotary switch actuating mechanism for at least two control elements is provided, including at least one axial cam, parallel to the axis of rotation, which, in a given position of the rotary switch actuating mechanism, comes into direct engagement with one of the control elements through a transmission lever actuated by the cam in another position of the rotary switch actuating mechanism for acting on another control element.

3 Claims, 2 Drawing Sheets

ROTARY SWITCH ACTUATING MECHANISM FOR ACTUATING AT LEAST TWO PLUNGER CONTROL ELEMENTS

CROSS REFERENCE TO PRIOR APPLICATIONS

This application is a continuation of Ser. No. 07/144,976, now abandoned.

BACKGROUND OF THE INVENTION

The invention relates to a rotary switch actuating mechanism actuating at least two plunger control elements.

It relates more especially to switching and/or signalling apparatus which have, for example on a lid of a case, rotary knobs and push-buttons, for actuating, through plunger control elements, switching units situated in the case. Because of the lack of space on the lid of the case, only a limited number of knobs or push-buttons may be located there. In addition, it is often difficult, particularly in the case of plunger control elements which are close to each other to assign its knobs or push-button member to each control element.

The invention provides a rotary switch actuating mechanism of the above mentioned type, making it possible to actuate several plunger control elements even if they are close together, in a secure manner, while keeping a simple and compact structure.

SUMMARY OF THE INVENTION

This result is reached by providing at least one axially acting cam, parallel to the axis of rotation of a rotary knob, which cam, in a given position of the rotary knob, comes into direct engagement with one of the plunger control elements of the switching units and by adding to the cam a transmission lever which the cam actuates in another position of the rotary knob for acting on another plunger control element.

The rotary switch actuating mechanism of the invention may not only actuate plunger control elements assembled closely together but also control elements which are comparatively distant from each other.

The transmission lever has the advantage of including a sleeve which encloses, at least partially, the circularly movable cam, this sleeve engaging with the plunger control element which is associated therewith. Since the sleeve of the transmission lever may be practically adjacent to the cam, control elements may be actuated in very closely related positions without other precautions.

BRIEF DESCRIPTION OF THE DRAWINGS

Other features, as well as the advantages of the invention will be clear from the following description of one embodiment.

In the accompanying drawings.

DESCRIPTION OF THE PREFERRED EMBODIMENT

Figure 1:
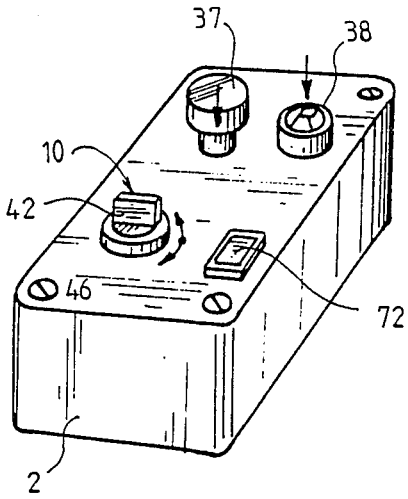
FIG. 1 shows the upper accessible part of a rotary switch actuating mechanism disposed in a lid of a switching and/or signalling apparatus case.
Figure 3:
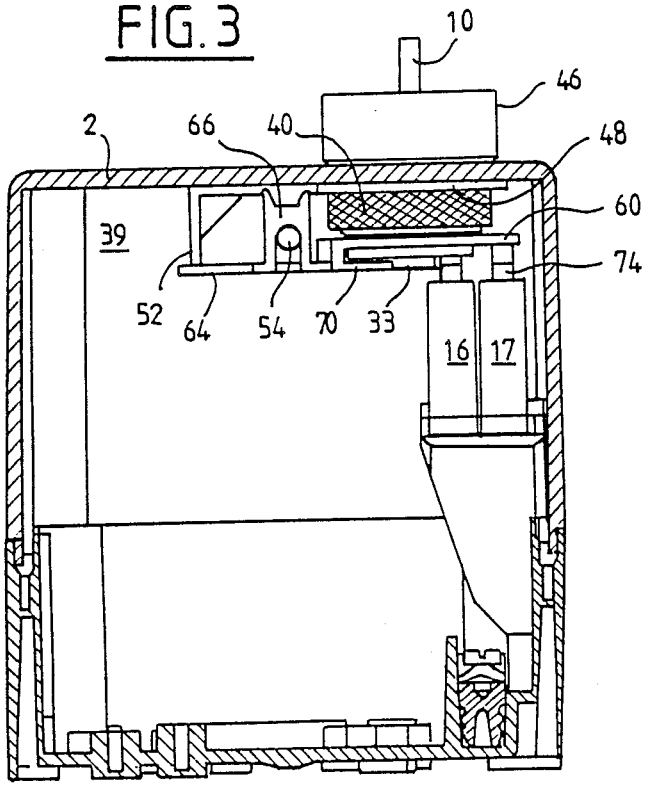
FIG. 3 is a sectional view of the lid and rotary switch actuating mechanism.

FIG. 1 shows the lid 2 of the case of a switching and/or signalling apparatus whose upper face serves also as support for a rotary switch actuating mechanism 10. The rotary switch actuating mechanism 10 has an elongate rotary knob 42 projecting from the surface of lid 2, which knob can be rotated manually in both directions.

This knob 42 pivots at its base in an upper socket 46 joined to a cylindrical extension 58 (FIG. 2) passing through the lid and serving as a stop which bears on the face of lid 2.

Besides the rotary switch actuating mechanism 10, the lid includes two push-buttons 37, 38 as well as an observation window 72 for a display element.

Figure 2:
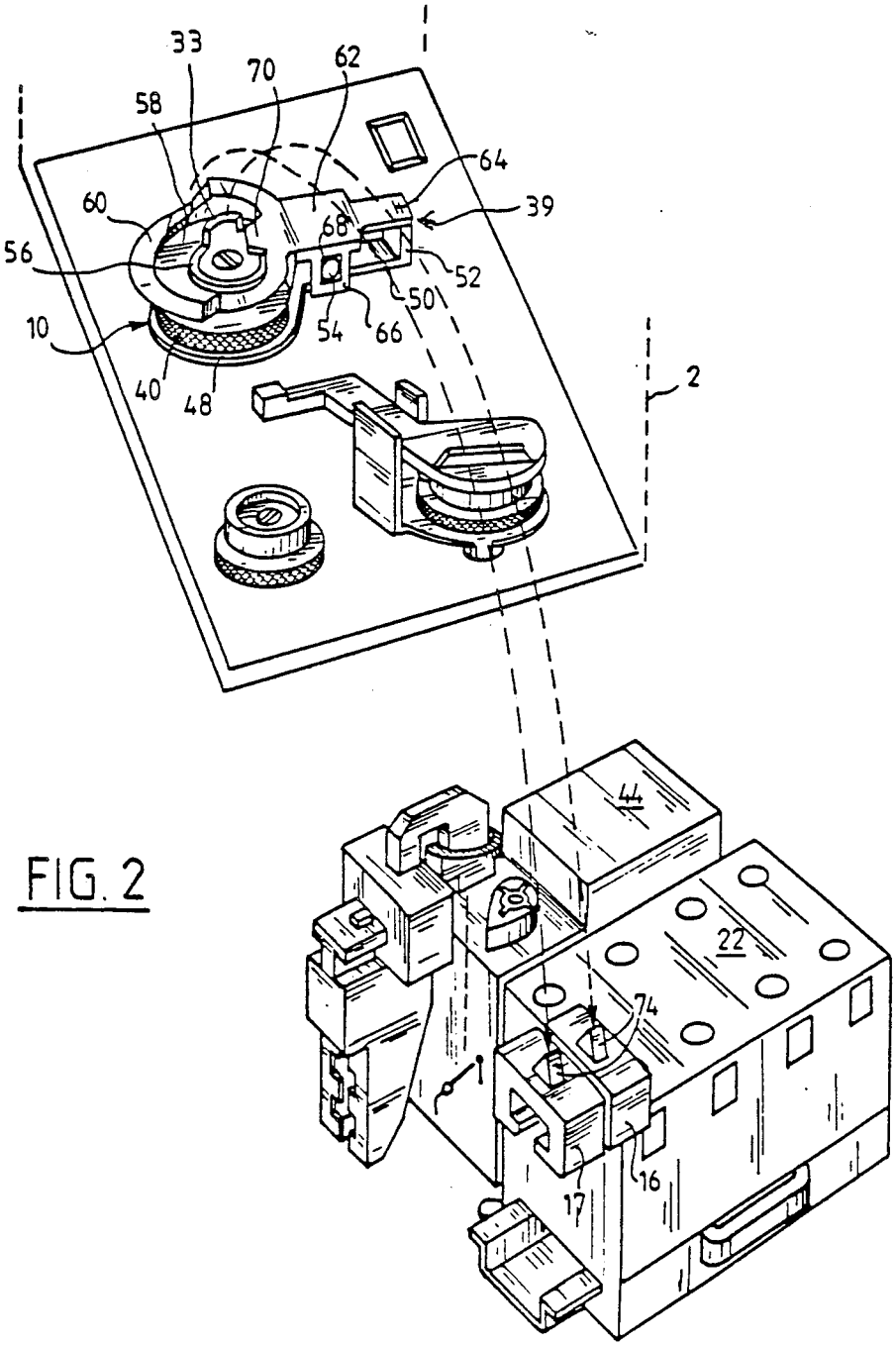
FIG. 2 shows the lower part of the rotary switch actuating mechanism of FIG. 1 disposed in the case of the apparatus, including a control unit situated in the case with the plunger control elements associated with the rotary switch actuating mechanism.

FIG. 2 shows (inverted) the lower inside surface of lid 2 with the lower part of the rotary switch actuating mechanism 10 housed in the case, as well as a contactor 22 and a thermal relay 44 forming a control unit, housed in the base (not shown) of the case of the switching and/or signalling apparatus concerned.

The contactor 22 includes two plunger control elements 16 and 17 actuated alternately by the rotary switch actuating mechanism 10.

The rotary switch actuating mechanism includes an axial cam 33, parallel to the axis of rotation of the knob 42. This cam 33 engages with the plunger control element 16 in a first angular position of the rotary switch actuating mechanism 10.

Cam 33 is formed on a socket 56 which pivots in the cylindrical extension 58. Socket 56 has an inner end wall through which passes a screw 57 which connects socket 56 to the part of the switch which includes the elongate knob 42. Rotation of knob 42 thus rotates cam 33.

Cam 33 is bevelled on two sides and engages with a triangular abutment 74 for actuating the control plunger 16, as symbolized by a pecked line in FIG. 2.

The cylindrical extension 58 connected to upper socket 46 includes an external threaded portion on which is screwed an adjustment nut 40.

Between the adjustment nut 40 and lid 2 is inserted a clamping ring 48 extended by a radial bar 50 whose free end is bent at right angles so as to form a stop 52.

Cam 33 cooperates with a rocking transmission lever 39, one end portion 64 of which touches stop 52. This transmission lever 39 is rocked by cam 33 for acting on the control plunger element 17 in a second angular position of the rotary switch actuating mechanism 10.

The rocking transmission lever 39 includes a sleeve portion 60 which surrounds the rotatable cam 33. The sleeve portion 60, concentric with the socket 56 carrying the cam 33, engages with the actuating element 74 associated with the plunger control element 17, as symbolized by a pecked line in FIG. 2.

The transmission lever 39 has a middle portion 62 which links the sleeve portion 60 to the end lug 64, the latter being substantially narrower than the middle portion 62. The middle portion 62 further has an extension 70 projecting into the circular space defined by sleeve 60 and engaging with cam 33 at the corresponding position of the rotary switch actuating mechanism 10.

Thus, the transmission lever (60-70-64), actuated by cam 33, causes the end lug 64 to touch the free end of stop 52. The transmission lever 39, which is made at least partially of a resilient material, will be slightly deflected by its sleeve portion 60 in the direction of the control element 17, without being subjected to any rotary motion.

When cam 33 is disengaged from the extension 70, the resilient transmission lever 39 will resume its initial shape.

The part of sleeve portion 600 contiguous with the middle portion 62 is stronger than its part cooperating with the plunger control element.

The middle portion 62 is extended by two vertically fixed plates 66*a*, 66*b*, which define a recess 68 receiving pivot studs 54.

The pivot studs 54 are placed on two supports as shown, situated on radial bar 50 and on which the middle portion 62 of the transmission lever rests.

The middle portion 62 with the extending plates 66*a*, 66*b*, mounted by snap fitting on these supports 48, 50.

What is claimed is:

1. A rotary switch actuating mechanism, for actuating at least first and second plunger control elements, said mechanism including:

(i) a control knob mounted on a support for rotation about a first axis from a first and a second angular location;

(ii) at least one cam rigidly connected to the knob and rotating about said first axis, said cam engaging the first plunger control element when the knob is in said first angular location, and (iii) a rockable transmission lever mounted for rocking about a second axis substantially normal to said first axis which is fixed with respect to said support, said lever being actuated by the cam when the know is in the second angular location and engaging said second plunger control element.

2. The rotary switch mechanism of claim 1, wherein the transmission lever includes a sleeve portion at least partially surrounding the cam, said sleeve portion engaging the second plunger control element when the knob is in the second angular location, said transmission lever further including an end lug and a middle portion linking said sleeve portion to said lug, said middle portion having a projecting extension with which the cam cooperates for rocking the tranmission lever, while said lug cooperates with a stop which is fixed with respect to said support for limiting the rocking motion of the transmission lever.

3. In an apparatus comprising, housed in a case having a lid provided with at least one aperture and having inner and outer surface portions, switching electric apparatus including at least first and second movable plunger control elements, a rotary actuating mechanism comprising:

(i) a control knob having a first axis of rotation and first and second angular locations about said first axis, said control knob projecting out of the case through said aperture from said outer surface portion and being pivotally mounted in a socket located out of the case, said socket having a cylindrical extension which projects through said aperture internally of the case, said cylindrical extension having an external threaded portion and a nut being screwed on said threaded portion, while a clamping ring is inserted between said nut and said inner surface portion;

(ii) at least one cam formed on a further socket which is pivotally mounted in said cylindrical extension and rigidly connected to the control knob, said cam engaging the first plunger control element when the knob is in said first angular location;

(iii) a rockable transmission lever mounted for rocking about a second axis substantially normal to said first axis including a sleeve portion at least partially surrounding the further socket, said sleeve portion engaging the second plunger element when the knob is in said second angular location, said transmission lever further including an end lug and a middle portion linking said sleeve portion to said lug, said middle portion having a projecting extension with which the cam cooperates for rocking the transmission lever wherein said middle portion is hinged on said bar between said free end and said clamping ring; and (iv) a bar integrally formed with the clamping ring and radially extending the clamping ring, said bar having a free end which is bent at right angles to form a stop, said stop cooperating with said lug for limiting the rocking motion of the transmission lever.

* * * * *